US006129288A

United States Patent [19]

Petersen et al.

[11] Patent Number: 6,129,288

[45] Date of Patent: Oct. 10, 2000

[54] RAILROAD CROSSING PANEL FILLER

[75] Inventors: Rick W. Petersen; Steven R. Mattson, both of Spokane, Wash.

[73] Assignee: CXT, Incorporated, Spokane, Wash.

[21] Appl. No.: 09/174,176

[22] Filed: Oct. 16, 1998

[51] Int. Cl.[7] ..... E01B 2/00

[52] U.S. Cl. ..... 238/8; 238/3; 238/2; 238/7

[58] Field of Search ..... 238/2, 3, 4, 5, 238/6, 7, 8, 9, 382

[56] References Cited

U.S. PATENT DOCUMENTS

| | | | |
|---|---|---|---|
| 4,093,120 | 6/1978 | Canfield | 238/8 |
| 4,203,547 | 5/1980 | van der Harat | 238/8 |
| 4,236,670 | 12/1980 | Limmergard et al. | 238/8 |
| 4,415,120 | 11/1983 | Thim | 238/8 |
| 4,461,421 | 7/1984 | Maass | 238/8 |
| 4,606,498 | 8/1986 | Grant et al. | 238/8 |
| 4,793,545 | 12/1988 | Raymond | 238/8 |
| 4,899,933 | 2/1990 | Martin | 238/8 |
| 5,464,152 | 11/1995 | Wabnitz | 238/8 |
| 5,535,947 | 7/1996 | Hogue et al. | 238/2 |
| 5,535,948 | 7/1996 | Williams | 238/8 |
| 5,538,182 | 7/1996 | Davis et al. | 238/8 |
| 5,577,662 | 11/1996 | Hogue et al. | 238/8 |
| 5,655,711 | 8/1997 | Hull et al. | 238/8 |
| 5,850,970 | 12/1998 | Hull et al. | 238/8 |
| 5,899,379 | 5/1999 | Bruyn et al. | 238/8 |

FOREIGN PATENT DOCUMENTS

| | | | |
|---|---|---|---|
| 2350759 | 4/1975 | Germany | 238/314 |

*Primary Examiner*—S. Joseph Morano
*Assistant Examiner*—Frantz Jules
*Attorney, Agent, or Firm*—Wells, St. John, Roberts, Gregory & Matkin P.S.

[57] ABSTRACT

A railroad crossing panel filler for attachment to a headed support member on a railroad crossing panel slab includes an elongated elastomeric filler body with a slab engaging surface formed along the body. A rail engaging surface is also formed along the filler body opposite the slab engaging surface. An elongated support member head receiving channel is formed within the filler body and extends along the length thereof between the slab engaging surface and the rail engaging surface. An elongated support member receiving slot extending along the length of the filler body and includes a first open end along the slab engaging surface and a second end opening into the enlarged support member head receiving channel. The support member head receiving channel and support member receiving slot are configured to releasably receive a headed panel support member to releasably mount the elastomeric filler body to the panel.

21 Claims, 4 Drawing Sheets

RAILROAD CROSSING PANEL FILLER

TECHNICAL FIELD

The present invention relates to sealing the space between roadway surfaces and railroad rails at railroad crossings.

BACKGROUND OF THE INVENTION

Railroad crossings present a problem both for railroad track designers and highway roadbed designers. The roadbed must be built up to the level of the rails to allow wheeled traffic to flow across the rails. However the railroad car wheels have flanges that project below the surfaces of the rails and thus require an open space below the top surfaces of the rails for safe operation. Construction of crossings with adequate spacing adjacent the railroad rails thus requires gaps along side the rails which are objectionable to highway motorists. Still further, the rails must be accessible for maintenance and repair without seriously interrupting highway vehicle traffic.

To prevent build-up of debris within the spaces adjacent rails in crossings, fillers have been developed to span the gap between the roadway surface and the railroad rails. The fillers serve a two-fold purpose. They help prevent build-up of debris within the spaces, and they provide a relatively smooth surface over which vehicles may move.

In many present installations, railway crossing panels are produced that are placed in the roadway, joining the roadway on opposite sides of the track crossing. Fillers are produced for panels and are attached in different manner during panel formation. In some instances the fillers are cast with the concrete panels. In other instances the fillers are installed after the panels are set along the tracks. In still other instances, the fillers are placed on the panels just before the panels are placed in the crossing.

In instances where the fillers are integrated with the cast panels, difficulty arises when the fillers need to be replaced. The fillers, being integrated with the panels, cannot be replaced without replacing the panels.

In instances where the fillers are placed after setting of the panels, inadequate securing arrangements are provided to assure that the fillers will stay in position. Adhesives have been used as a solution to this problem without much success.

A reasonable solution seems to be mounting of the fillers in a relatively fixed position on panels just before the panels are set in place in the crossings. However prior fillers designed for this type of installation are generally difficult to install and are typically quite expensive.

The present invention provides a solution to the above problems by providing a railway crossing filler and panel in which the filler is inexpensive and that is easily installed on the panel and in which the filler, once placed, will be adequately held in place within the spaces provided adjacent the rails.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
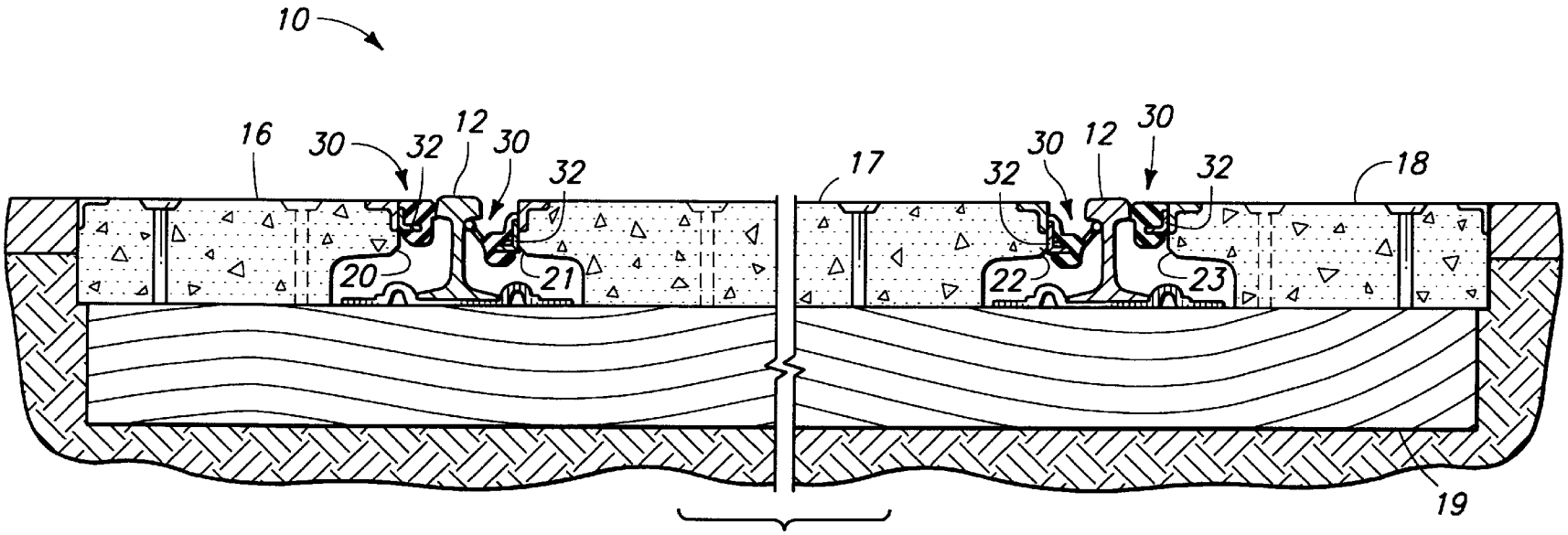
FIG. 1 is a cross-sectional view of a crossing panel installation at a railroad crossing with a preferred form of the present invention installed therewith.

FIG. 1 of the drawings exemplifies a section of a railroad crossing 10 in which railroad rails 12 cross a roadway. Concrete crossing panels are comprised of rigid slabs 16, 17, and 18 that are arranged alongside the rails 12 in order to equalize the elevation of the roadway surface with that of the rails 12. The outside slabs 16, 18 are substantially mirror images of one another and are commonly referred to as the "field" slabs. The central slab 17 fits between the rails 12 and is commonly referred to as the "gauge" slab.

The slabs are generally formed of cast and reinforced concrete and rest upon conventional ties or "sleepers" 19, which also support the rails 12. The rails are anchored in place by conventional rail clips or other appropriate fasteners. The thickness of the slabs may vary but is usually selected to be approximately equal to the distance from the top of the rails to the top of the ties, thereby elevating the roadway surface to that of the top surfaces of the rails 12.

The slabs also include respective slab edges 20, 21, 22, and 23 that are configured and positioned to produce an open space on each side of the rails 12. The present fillers, generally indicated at 30, are intended to span the spaces between the slab edges and the rails to prevent debris and moisture buildup within the spaces, and to provide smooth transition for vehicles across the rails 12.

It is noted that the filler 30 is provided in two exemplary forms, one for the outside or "field" areas which include the field slabs 16 and 18; and another for the central or "gauge" area which includes the central gauge slab 17. Though two different forms of fillers 30 are shown, both include similar features which will be referred to herein using similar reference numerals. The external surfaces of the fillers 30 vary according to the wheel configuration of railroad car wheels. Such wheels (not shown) have a flange that overlaps and extends downwardly into the gauge area so the fillers 30 shown attached to the central gauge slab 17 are provided with a recess to accommodate the wheel flanges. No such flange is found on the field side of the wheels, so the fillers 30 attached to the field slabs 16, 18 do not need to provide recesses and instead may have top surfaces that are substantially co-planar with the roadway surface defined by the top surfaces of the slabs.

It is noted that portions of the slab edges 20–23 adjacent the top surfaces are upright and face the respective rails 12. These parts of the slabs function as mounting surfaces for elements to be described in greater detail below.

A support member 32 is mounted to each of the slab edges 20–23 and includes a laterally extending part that projects outwardly therefrom (toward the rails 12). Each support member 32 is preferably elongated and formed of a rigid material such as steel. The support members may be attached to the slab edges 20–23 by conventional means such as anchor bolts or by welds (not shown).

Figure 2:
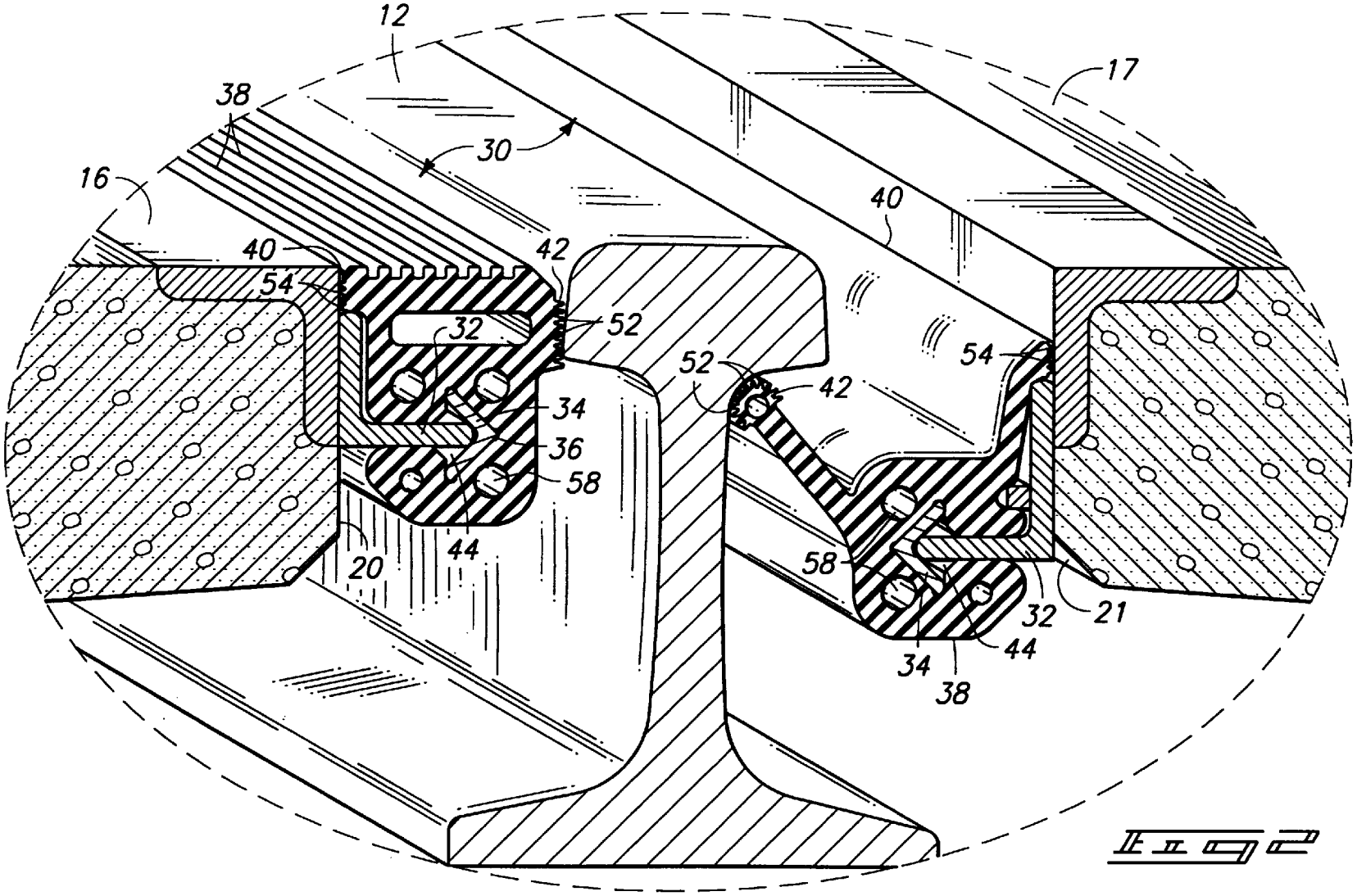
FIG. 2 is an enlarged detail view showing portions of panel slabs, a rail, and preferred forms of the present filler.

As may be noted in FIGS. 1 and 2, the support members 32 and fillers 30 are configured to support the fillers 30 well above the bottom surfaces of the rail openings. This is advantageous to enable placement of a wide selection of rail fasteners or other equipment within the spaces created (between the fillers and the bottom surfaces of the rail openings).

It is preferable that the support members 32 be substantially horizontal when installed in a crossing as shown in FIGS. 1 and 2. It is also preferable that the support members 32 extend along the lengths of the panel slabs to provide maximum support for the fillers 30.

Figure 3:
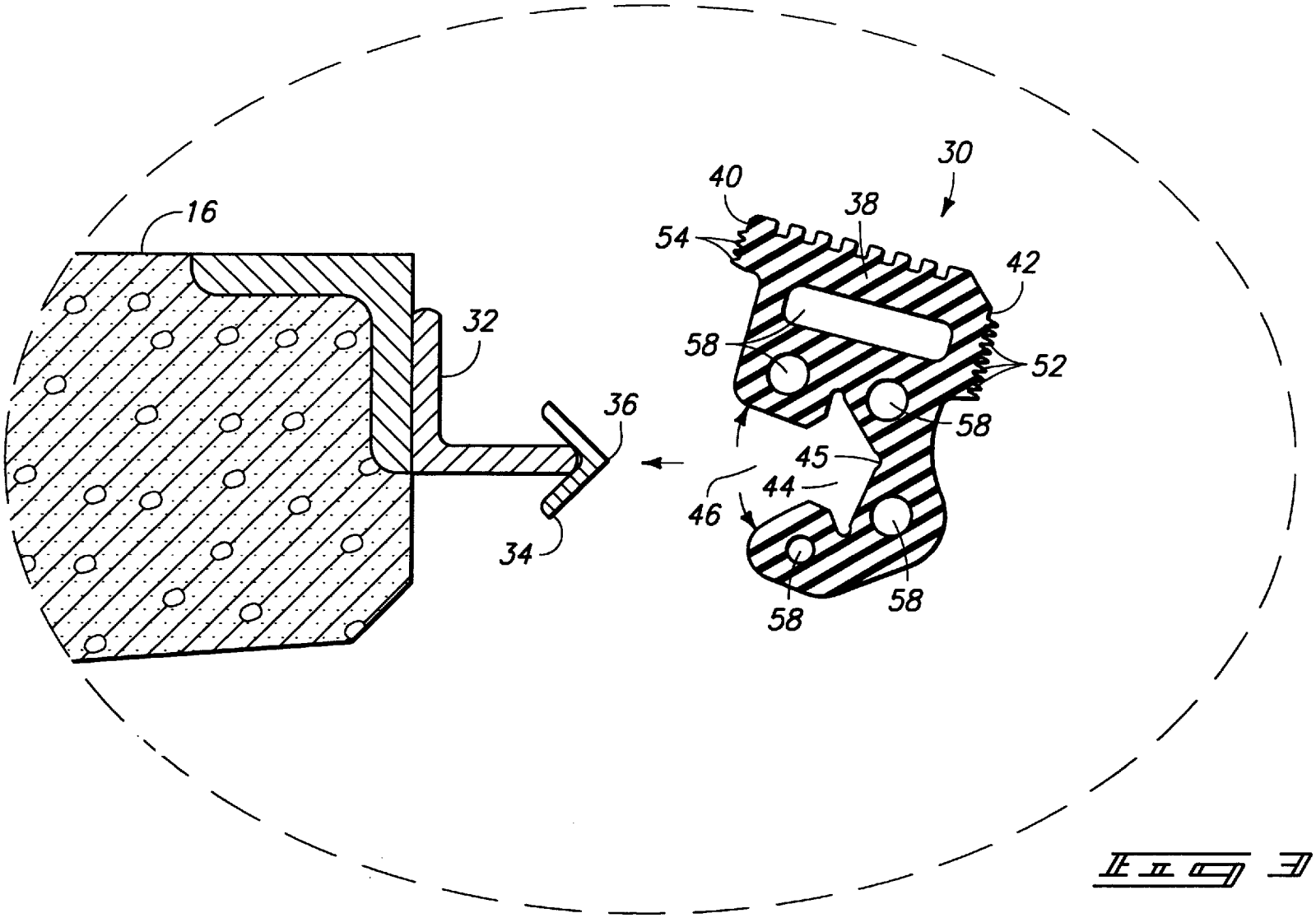
FIG. 3 is an exploded view showing one mode of installation for a preferred form of the present filler on a support member.

It is also preferred that laterally extending outward ends of the support members 32 include enlarged heads 34. The presently preferred head configuration is of a somewhat "arrowhead" shape with a pointed end 36. In preferred forms, this shape is formed by use of elongated "angle iron," welded in the angular relationship shown clearly in FIG. 3 to outward ends of the support members 32. The heads 34 may be elongated and are generally preferred to extend along the full length of the support members 32. Heads 34 of the illustrated configuration represent a form of barb that is used to secure the fillers 30 in place and prevent them from slipping off the support members even under adverse conditions.

In general, the preferred filler 30 is formed of an elastomeric material. More particularly, the preferred filler 30 is formed of a rubber material that is capable of being extruded by conventional extrusion apparatus. It is also preferred that the material be of a Shore A durometer (hardness) value of between approximately 65 and 80. It is also preferred that the selected material be highly electrically insulative, since it is desirable to electrically insulate one rail 12 from the other across the central gauge slab 17 within a crossing. An example of an appropriate material having all the desirable characteristics given above is produced by Monsanto and sold under the trademark "SANTOPRENE."

The preferred filler 30 includes an elongated elastomeric filler body 38 that includes a slab edge engaging surface 40 formed along the filler body to be positioned against one of the slab edges 20–23. A rail engaging surface 42 is formed along the filler body opposite the slab engaging surface. The rail engaging surfaces 42 are configured to be positioned in contact with the adjacent railroad rail when the fillers are installed.

It is noted once again that the fillers 30 include common features that may have variant appearances. An example is the variant configurations of the rail engaging surfaces 42. The filler 30 on the field side includes a rail engaging surface 42 that is substantially flat and upright. The rail engaging surfaces 42 of the fillers 30 on the gauge side include elongated flexible webs that extend angularly upward and toward the rail head from the associated filler body to provide a formed recess for rail car wheel flanges.

Preferred fillers 30 each include an elongated support member head receiving channel 44 that is shaped to releasably receive the support member head 34. The channel 44 is formed within the filler body along the length thereof between the slab edge engaging surface 40 and the rail engaging surface 42. In preferred forms, the channel 44 is formed in somewhat of an "arrowhead" configuration, complementary to the enlarged head 34 of the support member and including a pointed end 45 substantially aligned with and opposed to the support member receiving slot 46 (described below).

Each of the preferred fillers 30 also includes an elongated support member receiving slot 46 that releasably receives the outwardly projecting extent of the support member 32 and extends along the length of the filler body. The preferred slot configuration includes a first open end 48 extending along the slab edge engaging surface 40, and a second end 50 opening into the enlarged support member head receiving channel 44.

The head receiving channel 44 and support member receiving slot 46 are formed to fit in a snug but releasable fashion over the support member 32 and support member head 34 with the slab edge engaging surface 40 operatively held against the associated slab edge 20–23 and with the rail engaging surface 42 projecting outwardly from the slab edge and positioned to yieldably engage the adjacent railroad rail 12.

In preferred forms, rail sealing fins 52 are formed into the filler bodies along the rail engaging surfaces 42. Also in preferred forms, slab edge sealing fins 54 are formed into the filler bodies along the slab edge engaging surfaces 40 and yieldably engaging the adjacent slab edges 20–23. It is preferred that the fins 52 and 54 extend the full length of the filler 30.

The fins 52 and 54 are provided to deflect and seal against the slab edges and rails (just below the top surface of the rail heads) when the fillers 30 are installed, effectively sealing the spaces below the fillers 30 against moisture and debris buildup.

A preferred form of the filler 30 also includes a number of elongated open passages 58 that are formed in the filler body and extend along the length thereof. The passages 58 are used to optimize the elastomeric filler extrusion process and to bestow desirable physical properties to the fillers 30.

It is noted that the present invention may be supplied as a combination in which the crossing panel is supplied along with the filler 30, wherein the fillers 30 and support members 32 are provided for attachment to existing panel slabs, or wherein the fillers 30 are provided for attachment to slabs where the support members 32 have been previously installed. Installation and operation of the filler may be performed in a similar manner in either situation.

In the combination, the panel slabs are constructed using known concrete forming and placing techniques. The support members 32 are attached to the edge surfaces 20–23 either during the pouring procedure, using known form of anchors or welds to hold the support members 32 in place or following set up of the concrete, using conventional forms of attachment (such as welds or anchor bolts).

Figure 4:
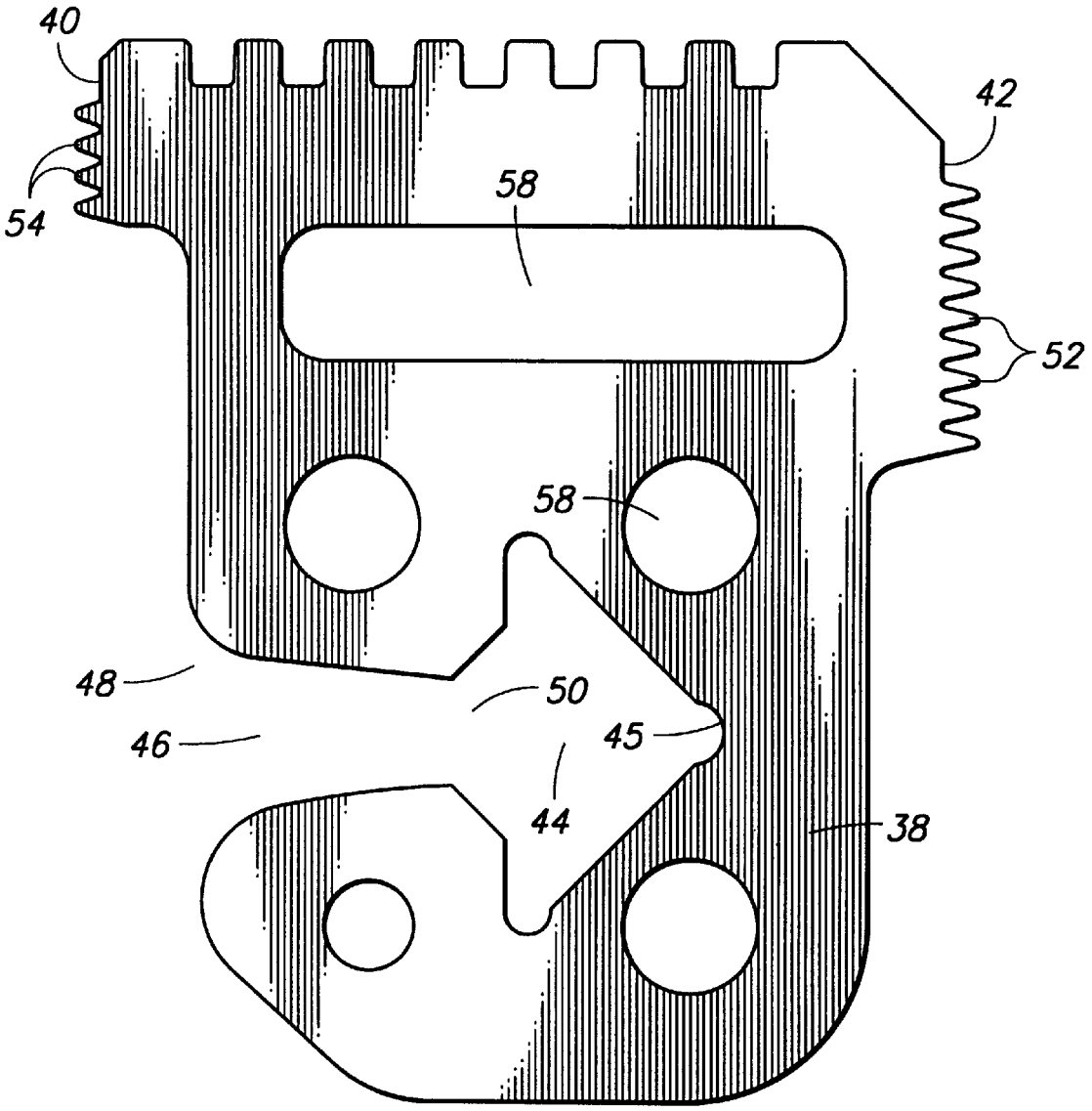
FIG. 4 is an enlarged sectional view of a preferred filler.

To install a filler 30, the user simply aligns the selected filler section with the slab engaging surface 40 facing the selected slab edge and with the support member receiving slot 46 in horizontal alignment with the laterally projecting extent of the associated support member 32. The filler may then be pried open to the open condition shown in FIG. 3, and be slipped over the extending part of the support member 32. The filler 30 may then be released to close to the normal condition shown in FIGS. 2 and 4, capturing the enlarged head 34 of the support member within the complementary channel 44 in the filler.

The filler 30 is now releasably attached to the support member 32 and will not work loose after installation, due to the barb-like connection to the support member 32 and the orientation of the support member, providing elevational and lateral support to the filler. The fillers 30 can be removed from the support members 32 by longitudinally sliding them from the support members or by separating the fillers and slipping them horizontally and laterally from the support members. The fillers 30 cannot work loose due to traffic, or vertical loading due to the orientation of the support members 32 and the barb-like connectors, along with friction generated by the sealing fins against the respective engaged surfaces of the rails and slab edges.

It is also possible, and in some instances preferable, to install each filler 30 by sliding it longitudinally onto the associated support member 32. A further installation procedure could also be to tap the filler 30 onto the laterally extending part of the selected support member 32, using the inclined surfaces of the enlarged head 34 to cam the slot 46 open. The inherent resiliency of the filler material will cause the filler 30 to close over the lateral extending part of the support member 32 once the enlarged head 34 is received within the channel 44.

The fillers 32 and laterally extending parts of the support members 32 function to prevent the slabs 16, 18 from migrating too close to the rails. If such migration occurs, the web portion of the adjacent rail will be engaged by the filler 30 and the projecting end of the support member 32, which will abut the rail web and resist any closer movement of the associated slab 16, 17 or 18. Gaps will therefore be maintained as a safety factor, between the rail heads and the slab edges 20–23.

The above installation operations may occur regardless of the nature of the filler, whether it be a field side filler or a gauge filler.

In use, the panel slabs will function as extensions of the adjacent roadway surface, to guide vehicles over the rails. During this time the fillers 30 function to prevent build up of moisture and debris within the spaces between the panel slabs and the railroad rails, while leaving adequate space below the fillers 30 for rail connectors or other apparatus.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A railroad crossing panel filler for attachment to a headed support member on a railroad crossing panel slab, comprising:

an elongated elastomeric filler body;

a slab engaging surface formed along the filler body;

a rail engaging surface formed along the filler body opposite the slab engaging surface;

an elongated support member head receiving channel formed within the filler body and extending along the length thereof and situated between the slab engaging surface and the rail engaging surface;

an elongated support member receiving slot extending along the length of the filler body and having a first open end formed along the slab engaging surface in opposition to the rail engaging surface and a second end opening into the enlarged support member head receiving channel;

wherein the support member head receiving channel and support member receiving slot are configured to releasably receive a headed panel support member to mount the filler body to the panel slab.

2. The railroad crossing panel filler of claim 1 further comprising rail sealing fins formed into the filler body along the rail engaging surface.

3. The railroad crossing panel filler of claim 1 further comprising panel slab sealing fins formed into the filler body along the support member engaging surface.

4. The railroad crossing panel filler of claim 1 further comprising:

rail sealing fins formed into the filler body along the rail engaging surface; and panel slab sealing fins formed into the filler body along the support member engaging surface.

5. The railroad crossing panel filler of claim 1 wherein the elastomeric filler body is formed of rubber.

6. The railroad crossing panel filler of claim 1 wherein the elastomeric filler body is extruded and wherein the channel and support member receiving slot are formed along the full length of the filler body.

7. The railroad crossing panel filler of claim 1 wherein the elastomeric filler body is formed of an electrically insulative rubber material.

8. The railroad crossing panel filler of claim 1 wherein the elastomeric filler body is formed of a rubber material having a shore A durometer value of between approximately 65 and 80.

9. The railroad crossing panel filler of claim 1 wherein the channel is formed in an arrowhead configuration with a pointed end substantially aligned with and opposed to the support member receiving slot.

10. The railroad crossing panel filler of claim 1 further comprising elongated open passages formed in the filler body and extending along the length thereof adjacent the support member head receiving channel and the support member receiving slot.

11. A railroad crossing panel, comprising:

a rigid slab including an elongated slab edge configured to be disposed adjacent a railroad rail with the slab edge upright and facing the rail;

a support member mounted to the slab edge and projecting outwardly therefrom;

an enlarged head on the support member;

a panel filler formed of an elastomeric material;

an elongated elastomeric filler body;

a slab engaging surface formed along the filler body and positioned against the slab edge;

a rail engaging surface formed along the filler body opposite the slab engaging surface configured to be positioned in contact with the railroad rail;

an elongated support member head receiving channel releasably receiving the support member head and formed within the filler body along the length thereof and situated between the slab engaging surface and the rail engaging surface; and an elongated support member receiving slot releasably receiving the support member and extending along the length of the filler body, with a first open end formed along the slab engaging surface and a second end opening into the elongated support member head receiving channel;

the support member and support member head supporting the panel filler with the slab engaging surface against the slab edge and with the rail engaging surface projecting outwardly from the slab edge and positioned to yieldably engage the railroad rail.

12. The railroad crossing panel of claim 11 further comprising rail sealing fins formed into the filler body along the rail engaging surface.

13. The railroad crossing panel of claim 11 further comprising slab edge sealing fins formed into the filler body along the slab engaging surface and yieldably engaging the slab edge of the rigid slab.

14. The railroad crossing panel of claim 11 further comprising:

rail sealing fins formed into the filler body along the rail engaging surface; and slab edge sealing fins formed into the filler body along the slab engaging surface.

15. The railroad crossing panel of claim 11 wherein the elastomeric filler body is formed of rubber.

16. The railroad crossing panel of claim 11 wherein the elastomeric filler body is formed of extruded rubber and wherein the channel and support member receiving slot are formed along the full length of the filler body.

17. The railroad crossing panel of claim 11 wherein the elastomeric filler body is formed of an electrically insulative rubber material.

18. The railroad crossing panel of claim 11 wherein the elastomeric filler body is formed of a rubber material having a durometer value of between approximately 65 and 80.

19. The railroad crossing panel of claim 11 wherein the enlarged head is formed in an arrowhead configuration with a pointed end facing away from the support member, and wherein the channel is formed in an arrowhead configuration complementary to the enlarged head with a pointed end substantially aligned with and opposed to the support member receiving slot.

20. The railroad crossing panel of claim 11 further comprising elongated open passages formed in the filler body and extending along the length thereof adjacent the support member head receiving channel and the support member receiving slot.

21. A railroad crossing panel filler assembly for attachment to a railroad crossing panel slab having a slab edge, comprising:

a support member configured to be secured to the slab edge and including an extending part;

an enlarged head on the extending part;

an elongated elastomeric filler body;

a slab edge engaging surface formed along the filler body;

a rail engaging surface formed along the filler body opposite the slab edge engaging surface;

an elongated support member head receiving channel formed within the filler body and extending along the length thereof between the slab engaging surface and the rail engaging surface releasably receivable over the enlarged head on the extending part of the support member;

an elongated support member receiving slot extending along the length of the filler body and having a first open end opening along the slab engaging surface and a second end opening into the enlarged support member head receiving channel, releasably receivable over the extending part of the support member; and wherein the support member head receiving channel and support member receiving slot releasably receive the enlarged head of the support member.

* * * * *

UNITED STATES PATENT AND TRADEMARK OFFICE

CERTIFICATE OF CORRECTION

PATENT NO. : 6,129,288
DATED : October 10, 2000
INVENTOR(S) : Rick W. Petersen, et al.

It is certified that error appears in the above-identified patent and that said Letters Patent is hereby corrected as shown below:

Column 3,
Line 43, after the word fillers add -- 30 --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*